US007009127B2

(12) United States Patent
Hoelzle et al.

(10) Patent No.: US 7,009,127 B2
(45) Date of Patent: Mar. 7, 2006

(54) SWITCH COMPRISING AN OPERATING ROCKER BUTTON

(75) Inventors: Wolfgang Hoelzle, Villingen-Schwenningen (DE); Siegfried Koch, Villingen-Schwenningen (DE); Ulrich Randau, Villingen-Schwenningen (DE)

(73) Assignee: Siemens AG, München (DE)

( * ) Notice: Subject to any disclaimer, the term of this patent is extended or adjusted under 35 U.S.C. 154(b) by 0 days.

(21) Appl. No.: 11/086,459

(22) Filed: Mar. 23, 2005

(65) Prior Publication Data

US 2005/0161315 A1 Jul. 28, 2005

Related U.S. Application Data

(63) Continuation of application No. PCT/DE03/02752, filed on Aug. 18, 2003.

(30) Foreign Application Priority Data

Sep. 10, 2002 (DE) ..... 102 42 273
Sep. 12, 2002 (DE) ..... 102 42 532

(51) Int. Cl.
*H01H 9/18* (2006.01)

(52) U.S. Cl. ..... 200/315; 200/517; 200/339

(58) Field of Classification Search ..... 200/310–317, 200/339, 557, 561, 553, 517, 18, 17 R, 4, 200/5 R, 556
See application file for complete search history.

(56) References Cited

U.S. PATENT DOCUMENTS 5,403,984 A * 4/1995 Ogawa ..... 200/517
5,714,732 A * 2/1998 Lee ..... 200/6 R
5,803,243 A * 9/1998 Nestor et al. ..... 200/556
6,388,221 B1 * 5/2002 Rudolph et al. ..... 200/556
6,605,790 B1 * 8/2003 Yoshida ..... 200/339
6,646,211 B1 * 11/2003 Taniuchi et al. ..... 200/4

FOREIGN PATENT DOCUMENTS

DE 26 36 632 A1 2/1978
DE 195 37 296 A1 4/1996
EP 0 386 277 A1 9/1990

OTHER PUBLICATIONS

Derwent Abstract—DE-19537296; Rocker switch for two-stage operating stroke e.g. for opening and closing motor vehicle electric windows have two sets of pressure switches each set having two switches, with straight line connecting one switch of each set extending obliquely to axial line of pivot axle.
Derwent Abstract—EP-386277; Double separation terminal clamp has opposing current rails within each stage cooperating with rotary separation switch piece.
Derwent Abstract—DE 26 36 632; Electric switch with toggle lever actuator has two part housing whose separating line in plane at right angles to lever tipping axis.

* cited by examiner

*Primary Examiner*—Michael A. Friedhofer
(74) *Attorney, Agent, or Firm*—Siemens AG; Jacob Eisenberg

(57) ABSTRACT

A switch is disclosed including an operating rocker button and at least one contact element which can be actuated by a radial deflection of the operating rocker button. The contact element can be actuated directly by the operating rocker button, or by the operating rocker button by a transmission element. As such, a locking function is provided via a projection on the transmission element or the operating rocker button, which co-operates with an elastic element.

8 Claims, 2 Drawing Sheets

SWITCH COMPRISING AN OPERATING ROCKER BUTTON

CROSS REFERENCE TO RELATED APPLICATIONS

The present application is a continuation of international application PCT/DE2003/002752, filed on Aug. 18, 2003, which designated the United States and was pending at the time of designation; and further claims priority to German patent applications 10242273.7, filed Sep. 10, 2002, and 10242532.9, filed Sep. 12, 2002, all of which are herein incorporated by reference.

BACKGROUND OF THE INVENTION

The invention relates to a switch having an operating rocker, in which a contact element can be operated by radial deflection of the operating rocker, and in which the operation of the contact element can be carried out by the operating rocker or by the operating rocker via a transmission element. In the prior art in this case, latching functions are provided by means of metallic lever and/or spring elements, which release a latching and snap-action mechanism.

SUMMARY OF THE INVENTION

The object of the present invention is to describe a switch having an operating rocker and latching functions but with a simpler construction. This object is achieved in that the latching function can be provided by a projection on the operating rocker or on the transmission element interacting with a sprung element. Since the projection can be inserted into the operating rocker or into the transmission element, it is possible to provide both latching and momentary-contact functions with one switch type, depending on whether the projection is or is not inserted. The sprung element has a particularly simple construction by being in the form of part of a switching mat. This means there is no need for any additional element. If the switching mat is formed from rubber or synthetic rubber, for example silicone, this leads to a permanent spring element. The sprung element is particularly functional if it has a structure whose cross section is in the form of waves and/or a sawtooth pattern. If the projection is in the form of a roller, this roller can on the one hand easily overcome the waves or sawteeth during operation of the operating aid, while nevertheless firmly holding the switch in the desired position in the wave troughs of the corrugated structure or in indentations in the sawtooth structure. If the switch has two projections and two contact elements, two switching operations can be carried out with one switch. In this case, if rollers are used as the projections, a latching or momentary-contact function of the switch can be provided depending on whether the roller is or is not inserted. When no rollers are present, a switch can thus be produced with two momentary-contact functions; when one roller is inserted, a switch can be produced with a latching and a momentary-contact function, and when both rollers are inserted, a switch can be produced with two latching functions. If the transmission element is in the form of a light box, this provides an additional function with one component.

BRIEF DESCRIPTION OF THE SEVERAL VIEWS OF THE DRAWINGS

The invention will be explained in more detail in the following text with reference to the figures, in which.

DETAILED DESCRIPTION OF THE INVENTION

Figure 1:
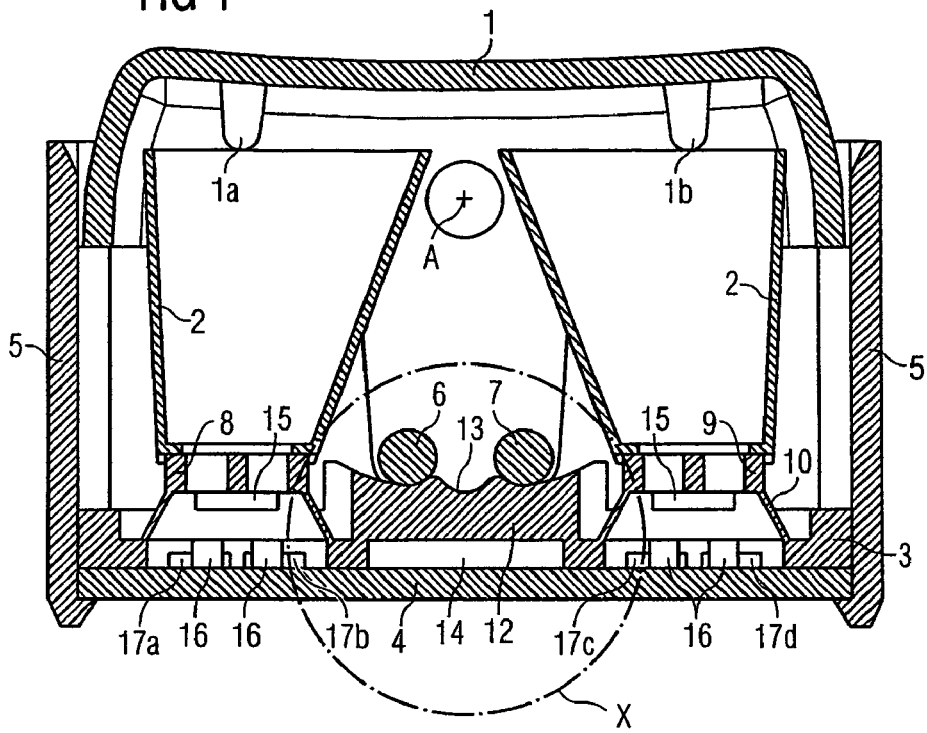
FIG. 1 shows the cross section through one particularly preferred switch according to the invention.

The particularly preferred exemplary embodiment of a switch according to the invention has an operating rocker 1, transmission elements in the form of light boxes 2, a switching mat 3, a printed circuit board 4 and a housing 5. The operating rocker 1 has tabs 1*a,* 1*b* and two projections in the form of rollers 6, 7. The operating rocker 1 can be deflected radially about an axis A. The switching mat 3 has keys 8 with key heads 9 which are connected via key feet 10 to a base plate 11 of the switching mat 2. Between the keys 8, the switching mat 2 has a sprung element 12 with a surface 13 having a cross section in the form of waves. The sprung element 12 has a cavity 14 between its lower face and the printed circuit board 2. Contact elements 15 are arranged on the lower faces of the key heads 9 and may be composed, for example, of carbon or conductive rubber.

The lower faces of the light boxes 2 rest on the upper faces of the key heads 9. Light-emitting diodes 16 and contact surfaces 17*a–d* are arranged on the printed circuit board 4. The contact surfaces 17*a, b* and 17*c, d* are in each case electrically isolated from one another.

Figure 2:
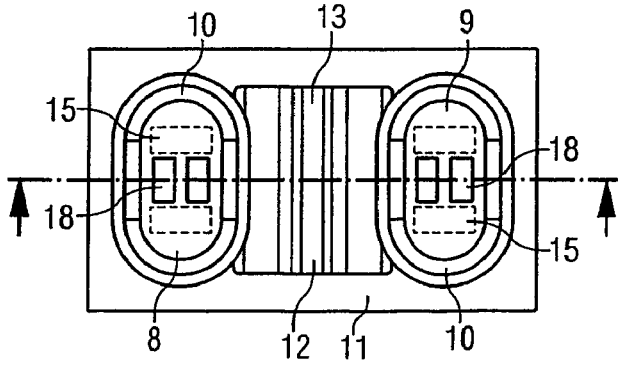
FIG. 2 shows a plan view of a switching mat as illustrated in FIG. 1.

FIG. 2 shows light openings 18 and the position of the contact elements 14 in the key heads 9; the figure also shows the corrugated surface 13 and the base plate 11.

Figure 3:
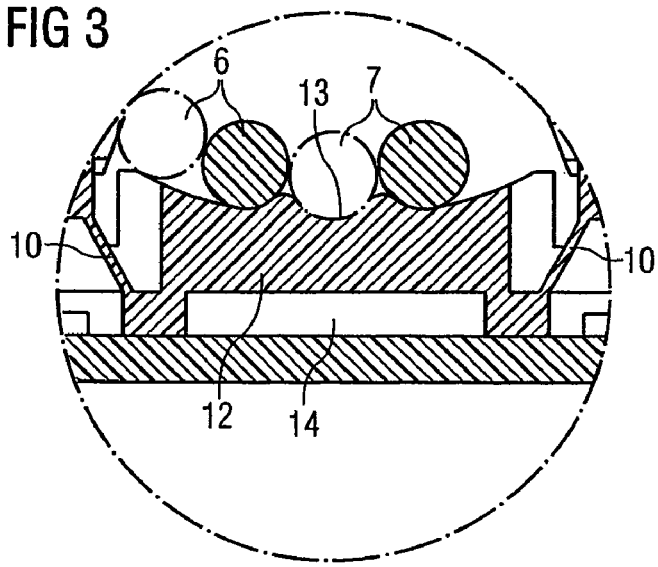
FIG. 3 shows the detail X from FIG. 1.

In FIG. 3, the rollers 5, 6 are each illustrated twice; shaded in one position which corresponds to the position in FIG. 1, and not shaded in the position which would correspond to the position if pressure were applied to the right-hand side of the surface of the operating rocker 1, thus pushing the right-hand key head 9 downwards with its contact element 15 electrically connecting the contact surfaces 17*c, d* to one another. Since the roller 17 is located in the central trough in the corrugated surface 13, the roller 7 and hence the operating rocker maintain their position.

Figure 4:
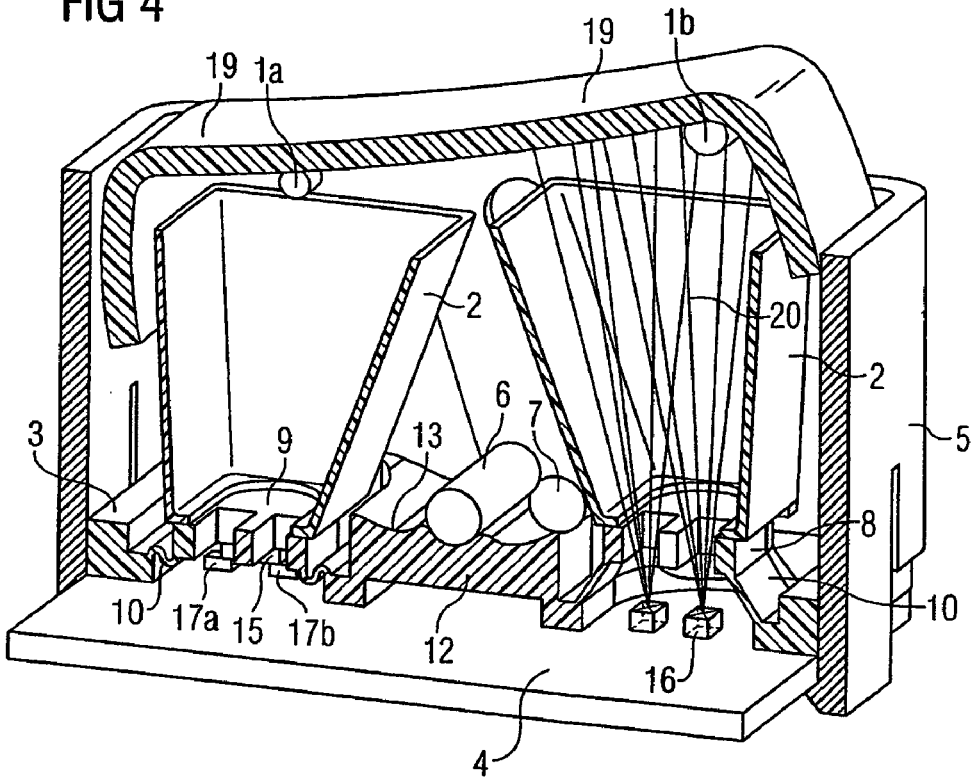
FIG. 4 shows a partial section through the switch from FIG. 1 in a first latching switching position.

FIG. 4 shows the switch from FIG. 1 in a switching position which occurs when pressure has already been applied to the left-hand side of the surface of the operating rocker 1. The roller 6 is latched in the central wave trough of the corrugated surface 13 of the sprung element 12. Thus, via the tab 1*a,* the operating rocker 1 presses the left-hand light box 2 against the surface of the right-hand key head 9 in such a way that the key feet 10 bend in, and the contact element 15 electrically connects the two left-hand contact surfaces 17*a, b* on the printed circuit board 5 to one another. The light-emitting diodes 16 which are arranged in front of the contact surfaces 17*a, b* are not shown, to assist clarity. The illumination of pictograms 18 which are arranged in the operating rocker 1 is shown on the right-hand side in FIG. 4: light beams 20 from the light-emitting diodes 16 pass through the light openings 18 through the right-hand light box 2 and illuminate a pictogram 19 in the operating rocker 1. The left-hand pictogram 19 is illuminated in a corresponding manner by the light-emitting diodes which are not shown on the left-hand side. When the operating rocker 1 is operated in a latched position as illustrated in FIGS. 1, 2 and 4, at least one roller 6, 7 is located in a wave trough in the corrugated surface 13, that is to say the roller 6 as illustrated in FIG. 4, the roller 7 as illustrated in white in FIG. 3 and both rollers 6, 7 as illustrated in black in FIGS. 1 and 2. Rotation of the operating rocker about the axis A results in at least one of the rollers 6, 7 being pressed against a rising area of the corrugated surface 13. Starting from the switching position illustrated in black in FIG. 1 or FIG. 3, the elasticity of the sprung element 12 pushes the rising surface downwards, so that either the roller 6 or the roller 7 moves into the central wave trough of the corrugated surface 13. Since one of the contact elements 15 is then resting on the contact surfaces 17*a, b* or 17*c, d,* the movement cannot be continued, and the switch remains in the last position even if an operator releases the operating rocker 1, since at least one of the rollers 6, 7 is located in a wave trough, so that an additional force is required to move it to the next wave trough and hence to the next switching position. If one of the rollers 6, 7 is not installed, this results in a switch which has a latching function in one direction and has a momentary-contact function in the other direction. If, for example, the roller 6 is omitted, the switch acts as a momentary-contact switch when pressure is applied to the left-hand side of the operating rocker since the roller 7 does not need to overcome any resistance; when pressure is applied to the right-hand side of the operating rocker as a latching switch, the roller 7 latches in the central wave trough. If both the rollers 6, 7 are omitted, this results in a pure momentary-contact switch. Thus, depending on which of the rollers 6, 7 is or are fitted to the operating rocker 1, this may result in a pure latching switch, a pure momentary-contact switch or a combined latching/momentary-contact switch. The elasticity of the sprung element 12 can be modified by the choice of material and by the configuration of the element, in particular by its thickness, the depth of the wave troughs and the height of the wave peaks that have to be overcome. The elasticity can also be influenced by varying the cavity 14.

The invention claimed is:

1. A switch, comprising;

an operating rocker, at least two contact elements arranged to be operated by radial deflection of the operating rocker, the contact elements arranged to be operable by the operating rocker or by the operating rocker via at least two transmission elements each of the transmission elements comprising a light box arranged to illuminate a portion of the switch, a latching functionality provided by a projection on the transmission elements or on the operating rocker interacting with a sprung element, and a first and a second set of light emitting means arranged to individually provide illumination to a first and a second of the transmission elements in response to a first and a second operation of the rocker.

2. The switch according to claim 1, wherein the projection is arranged so as to be inserted into the operating rocker or into the transmission elements.

3. The switch according to claim 1, wherein the sprung element comprises a switching mat.

4. The switch according to claim 3, wherein the switching mat comprises synthetic rubber or rubber and has at the least two contact element comprising electrically conductive material.

5. The switch according to claim 4, wherein the sprung element comprises a surface with a cross section in the form of waves or a sawtooth pattern.

6. The switch according to claim 3, wherein the sprung element comprises a surface with a cross section in a form of waves or a sawtooth pattern.

7. The switch according to claim 1, wherein the projection is a roller.

8. The switch according to claim 1, wherein the switch comprises two projections and two contact elements.

* * * * *